United States Patent [19]

de Dobo

[11] 3,955,903

[45] May 11, 1976

[54] ROTARY PISTON ENGINE WITH IMPROVED HOUSING AND PISTON CONFIGURATION

[75] Inventor: Tibor Louis de Dobo, Highland Park, N.J.

[73] Assignee: Aranka Elisabeth de Dobo, Basel, Switzerland

[22] Filed: May 10, 1974

[21] Appl. No.: 468,858

[52] U.S. Cl. ..... 418/61 B; 418/150

[51] Int. Cl.[2] ..... F04C 1/02

[58] Field of Search ..... 418/54, 60, 61 A, 61 B, 418/61 R, 150; 123/8.45

[56] References Cited

UNITED STATES PATENTS

| | | | |
|---|---|---|---|
| 3,102,492 | 9/1963 | Bentelle et al. | 418/150 X |
| 3,642,390 | 2/1972 | Ostberg | 418/150 X |
| 3,771,501 | 11/1973 | De Dobo | 418/61 B |
| 3,800,760 | 4/1974 | Knee | 418/61 A |

OTHER PUBLICATIONS

Wankel, *Motortechnische Zeitschrift*, Vol. 21, No. 2 of Feb. 1960, pp. 34–35.

*Primary Examiner*—C. J. Husar
*Assistant Examiner*—Leonard Smith
*Attorney, Agent, or Firm*—Behr & Woodbridge

[57] ABSTRACT

A rotary piston engine has a plurality of explosion chambers situated around the periphery of the housing and includes within the housing a piston. According to the preferred embodiment, a housing having H recesses would contain a piston having $P = H-1$ lobes. According to the preferred embodiment, the structure of the housing relative to the piston, and vice-versa, has been improved to give optimum results. The relationship between the housing and the piston is such that it may be characterized by an optimum mathematical relationship which can make the construction of such machinery simpler than has been heretofore known. Additionally, the relationship between the improved piston and housing configuration is related to other engine parameters such as the compression ratio and efficiency.

6 Claims, 6 Drawing Figures

ROTARY PISTON ENGINE WITH IMPROVED HOUSING AND PISTON CONFIGURATION

RELATED APPLICATIONS

This invention represents an improvement over the invention described in application Ser. No. 194,196, filed Nov. 1, 1971 and entitled "ROTARY PISTON WITH MULTI-EXPLOSION CHAMBERS", now U.S. Pat. No. 3,771,501 issued Nov. 13, 1973.

BACKGROUND OF THE INVENTION

1. Field of the Invention

This invention relates to internal combustion engines in general, and in particular to a rotary piston engine having an improved housing and piston configuration.

2. Description of the Prior Art

This invention discloses an improvement in the invention discussed in my U.S. Pat. No. 3,771,501 issued Nov. 13, 1973. While rotary piston engines of the sort disclosed in my previous patent are advantageous in many ways over other prior art combustion engines, it has heretofore been difficult to construct and fabricate these engines without a lot of trial and error. In order to improve the ease of construction of such devices a new relationship is proposed between the piston and the outer housing which will allow for simpler manufacture of parts. Additionally, the relationship between piston and its eccentric drive has been discovered which allows an eccentric drive mechanism to be constructed easily and inexpensively. Therefore, many problems posed by the prior art can be overcome by the use of the hereinafter described invention.

SUMMARY OF THE INVENTION

Briefly, in the preferred embodiments disclosed herein, a rotary piston engine is described in which the relationship between the piston and the housing is such that maximum advantages can be obtained from this construction. In particular, both the piston and the housing can be described in terms of an epitrochoid. If the housing is constructed according to an epitrochoid curve, then a piston can be constructed which will most readily fit and function within that housing. Conversely, for a given epitrochoid piston, a most suitable epitrochoid housing may be fabricated. It has been found that the relationship between the piston and the housing can be described in terms of five independant equations in eight unknowns. Given this situation it is possible to construct the best piston or best housing for a given set of parameters. Obviously, if three of the eight unknowns can be specified then the other five unknowns can be solved by means of the five simultaneous equations. Frequently, considerations such as the desired number of lobes, the ultimate size of the housing and the desired horse power will dictate several of the unknowns thereby leaving the fabricator with an easy means of solving for the other unknown quantities.

It can be shown mathematically that different compression ratios can be obtained by selecting appropriate values for the radius of the interior of the housing (R) and the eccentricity (e) of the drive mechanism. It is further possible to determine the maximum ratio of R to e to provide the maximum compression or horse power as desired. In a manner similar to the foregoing, an optimum relationship is proposed between the eccentric drive gearing system and the piston which will allow for improved construction efficiency and simplicity.

These and other advantages of the present invention will be more fully understood in view of the accompanying drawings.

DESCRIPTION OF THE PREFERRED EMBODIMENT

With reference to the following description it will be appreciated that like numbers and like letters will refer to similar elements as shown in the different views of FIGS. 1 – 4.

Figure 1:
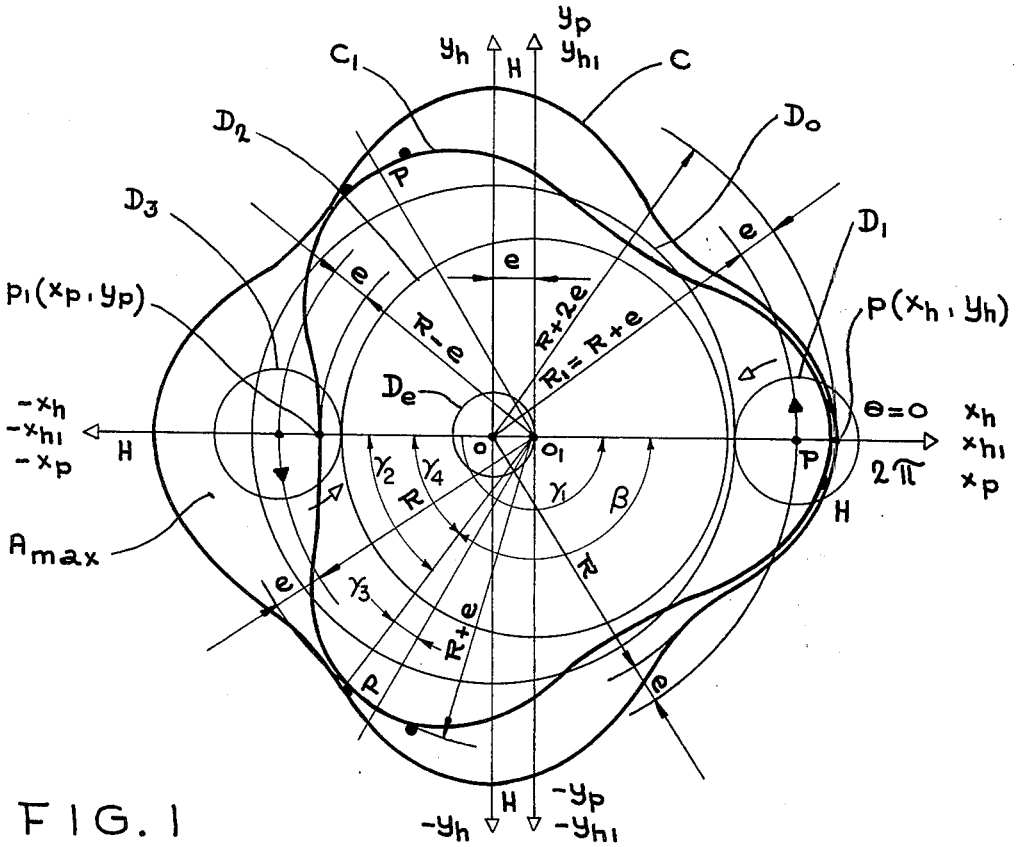
FIG. 1 is a cross section view of the preferred embodiment of the present invention.

A profile of the piston and the housing assembly according to a preferred embodiment of the present invention can be found with reference to FIG. 1. The recesses of the housing H and the lobes of the piston P can be expressed in terms of mathematical equations which generate epitrochoid curves. An important facet of this invention is the specific relationship between the shape of the piston and the shape of the housing given such an epitrochoid configuration. Before dealing with the specifics of the piston to housing relationship, the following background of history dealing with rotary piston engines should be understood.

According to the drawings, there is illustrated a rotary piston engine with dual explosion chambers, in which the stationary housing has H recesses and the rotary piston has $P = H - 1$ lobes. It will be noted with reference to FIG. 1 that the number of recesses of the housing $H = 4$ and that therefore the number of lobes of the piston $P = 4 - 1 = 3$. The curves generated in FIG. 1 are compound curves of high degree and are designated as C and $C_1$. It will be appreciated with respect to the described rotary piston engine that more than dual explosion chambers can be constructed using the same principles (not shown).

In general, the efficiency of a rotary piston engine with multiple explosion chambers depends upon the compression ratio E which is a relationship between the maximum volume $V_{max.}$ and the minimum volume $V_{min.}$. $V_{max.}$ is the maximum volume trapped between the eccentrically rotating piston surface and the stationary housing surface. The seals on the piston determine the size of the sealed cavity. Accordingly, $V_{min.}$ is the minimum volume trapped between the piston lobes and the engine housing. From this relationship it can be shown that:

$$E = \frac{V_{max.}}{V_{min.}} \quad (1)$$

where $E$ = Compression ratio.

$V_{max.}$ = Maximum volume.

$V_{min.}$ = Minimum volume.

According to the rotary piston engine of the present invention, the compression ratio E is limited by the rotary piston curve profile generating radius R and the eccentricity e of the rotary piston. More specifically, the compression ratio E is restricted by the ratio of R to e. This relationship is expressed in the following equation:

$$K = R/e \tag{2}$$

where $K$ = Ratio factor.

$R$ = Rotary piston curve profile generating radius.

$e$ = Eccentricity of the rotary piston.

With respect to the housing it can also be shown that the stationary housing curve profile generating radius $R_1 = R + e$ and that the eccentricity e of the rotary piston can be combined in the following relationship:

$$K_1 = \frac{R_1}{e} = \frac{R + e}{e} \tag{3}$$

where $K_1$ = Ratio Factor.

$R_1 = R + e$ = Stationary housing curve profile generating radius.

$e$ = Eccentricity of the rotary piston.

It is clear from the foregoing that given the rotary piston curve profile generating radius $R$ and the eccentricity of the rotary piston e it is possible to define the stationary housing curve profile generating radius $R_1$ from the relationship $R_1 = R + e$. Additionally, in view of the foregoing it can be shown that:

$$K_1 = K + 1 \tag{4}$$

The special significance of the foregoing relationships will be dealt with in more detail hereinafter.

Figure 2:
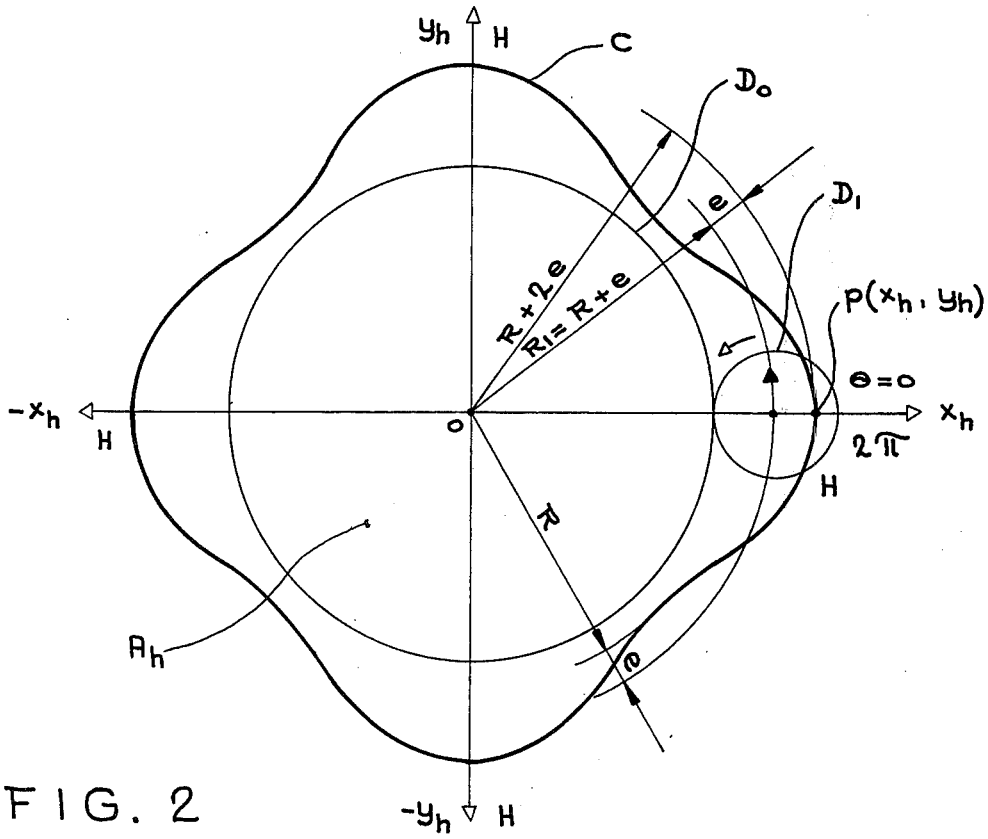
FIG. 2 is a detailed cross sectional view of the multi-recesses stationary housing.

A detailed description of the profile of the housing cavity is shown in FIG. 2. Essentially the profile C is an epitrochoid which is generated as a small circle with diameter $D_1$ rolls around the periphery of a larger circle with a diameter of $D_o$. The profile C is the locus of the point $p_h(x_h,y_h)$ as the circle with diameter $D_1$ revolves around the circle with diameter $D_o$. In other words, the profile C is the locus of points generated by point $p_h(x_h,y_h)$ as the point $p_h(x_h,y_h)$ moves through 360° of arc.

It will be evident from observing the contous of the housing interior of FIG. 2 that in order for the curve to be smooth and continuous, it is necessary that point $p_h(x_h,y_h)$ return to its originating point after 360° of revolution. In order for point $p_h$ to return to its original starting place, it is necessary that the circle with diameter $D_1$ revolve at integral number of times. In the example of FIG. 2 where $H = 4$ it is obvious from inspection that the circle with diameter $D_1$ revolves exactly five times with respect to the coordinate axis of the circle with diameter $D_o$. However, with respect to the periphery of the circle with diameter $D_o$, the circle with diameter $D_1$, of course, only revolves four times. In other words, the circle with diameter $D_1$ revolves exactly once for every 72° from arc. Stated another way, it is clear that in order to generate a smooth, continuous curve the circumference of the circle with diameter $D_1$ must be devisable into the circumference of the diameter of the circle with diameter $D_o$ with a resultant that is a whole integral number. That whole, integral is equal to the number of recesses H of the housing, and the following relationship is readily apparent from inspection:

$$H = D_o / D_1 \tag{5}$$

Another convenient way to describe the contour C of the housing profile is in terms of a minimum radius R and an eccentricity factor $e$. The minimum interior radius R is defined as the minimum distance between the center of the curve C and the closest portion of the curve C to the center 0. R may also be defined and will be shown later to be equal to the piston curve profile generating radius. The eccentricity factor e represents the displacement of the piston during its cyclical travel. The following relationship will also be clear from inspection of FIG. 2:

$$R + e = \frac{D_o + D_1}{2} \tag{6}$$

In the context of this invention the circle with diameter $D_1$ is referred to as the rolling circle and the circle with diameter $D_o$ is referred to as the fixed, or stationary, circle. The curve C is generated as the rolling circle revolves around the fixed circle.

When the chosen point $p_h(x_h,y_h)$ is on the circumference of the rolling circle with $D_1$ diameter, the curve generated thereby is called an epicycloid. The interior points generated by an epicycloid tend to be rather sharp and may not be desirable in a rotary piston engine. As the eccentric distance e is decreased relative to the diameter $D_1$ of the rolling circle, the points on curve C closest to the origin O become smoother. The curve generated when the point $p_h(x_h,y_h)$ is within the diameter $D_1$ of the rolling circle but not on the periphery of the circle, is called an epitrochoid. Stated another way:

$$\text{If } D_o/D_1 = R/e = K \tag{7}$$

then the curve is an epicycloid.

Conversely, if $$D_o/D_1 < (R/e = K) \tag{8}$$

then the curve is an epitrochoid.

Where $D_o$ = A fixed, stationary circle, for stationary housing.

$D_1$ = Rolling circle diameter, for stationary housing.

$R$ = Piston curve profile generating radius or minimum radius of housing curve C.

$e$ = Eccentricity of the rotary piston; and $K = R/e$ = Ratio factor.

In general, where H is less than or equal to 8, it is desirable to construct the stationary housing curve profile in the form of an epitrochoid. In the event where H is equal or greater than 9, it may be economically and technically desirable to make the profile of the stationary housing curve in the form of an epicycloid.

Figure 3:
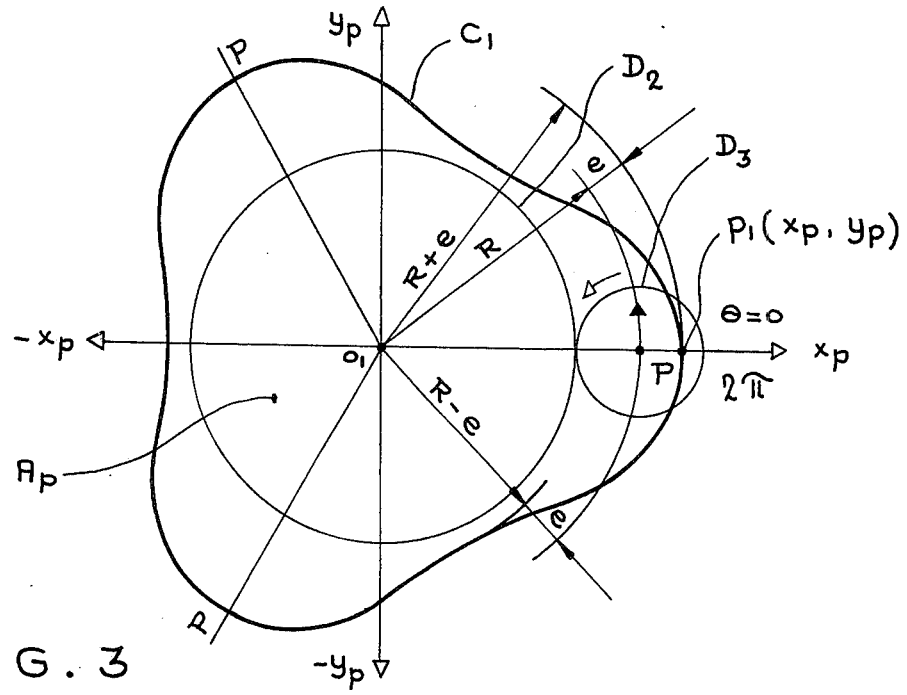
FIG. 3 is a view of the outline of a multi-lobe rotary piston which is received within the stationary housing of FIG. 1.
Figure 4:
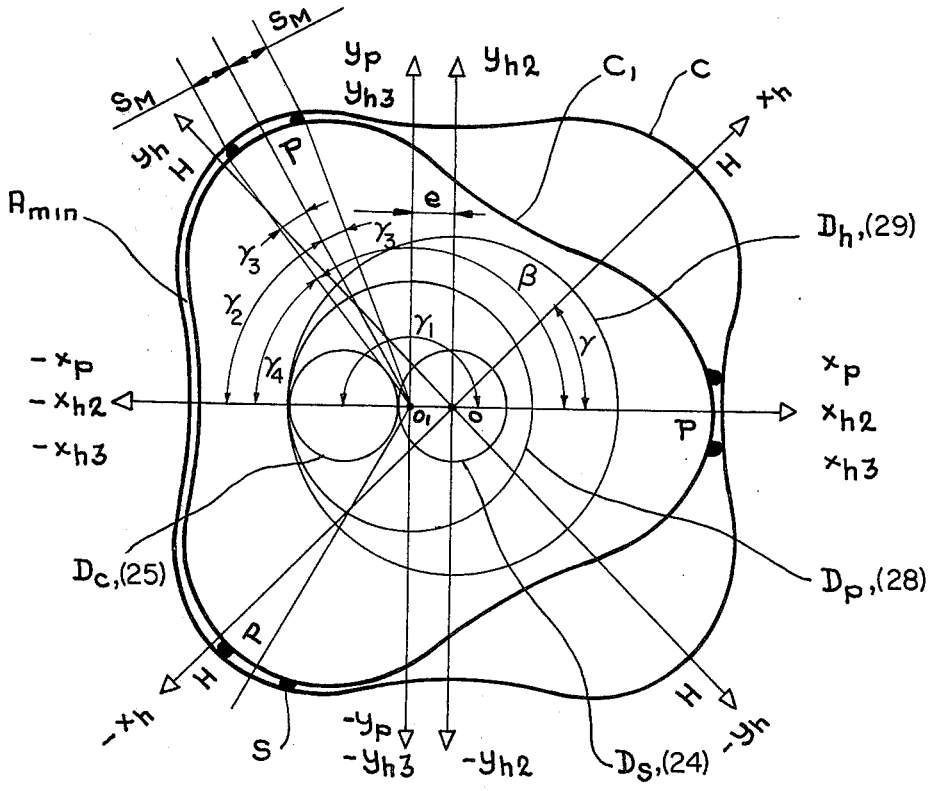
FIG. 4 is a cross sectional view of the invention according to a preferred embodiment in which the outline of the configuration of the eccentric gearing system is illustrated.

With reference to FIG. 3 the profile of the piston element may be generated in a similar fashion as the profile for the housing shown in FIG. 2. The profile of the piston is a curve $C_1$ generated by the locus of a point $p_p(x_p,y_p)$ located within the diameter $D_3$ of a rolling circle as it revolves through 360° of arc around a fixed circle of diameter $D_2$. In this manner, the generation of the profile curve of the piston is directly analogous to the method of generating the profile curve of the housing. In practice it has been found that the optimum piston size is achieved where the number of lobes P of the piston is one less than the number of recesses H of the housing.

It should be evident that while $H = P + 1$ is the most advantageous relationship, and it is practical to construct pistons in which $H$ is exactly one whole integer larger than $P$. It will be appreciated that $H$ and $P$, however, are always whole integral numbers.

As with the housing profile of FIG. 2, the piston profile $C_1$ may also be described in terms of the generating radius R and the eccentricity e. It will be clear from inspection and a careful review of the foregoing that:

$$R = \frac{D_2 + D_3}{2} \tag{9}$$

It is also clear, and especially in view of the discussion with respect to the housing profile, that in order to generate a smooth, continuous curve $C_1$ it is necessary that:

$$P = D_2/D_3 \tag{10}$$

Another way to express some of the foregoing relationships is by the equation:

$$\frac{H}{P} = \frac{D_0 \cdot D_3}{D_1 \cdot D_2} \tag{11}$$

however it will be appreciated that the foregoing relationship is not an independant relationship, but is instead a ratio between two previously discussed relationships.

A review of the relationship between housing profile C and piston profile $C_1$ will show that the optimum piston curvature for a given housing, or vice versa, can be expressed in terms of the following five independant equations:

I. $H = P + 1$;

II. $H = D_0/D_1$;

III. $P = D_2/D_3$;

IV. $R = \frac{D_2 + D_3}{2}$; and

V. $R + e = \frac{D_0 + D_1}{2} = R_1$

Where the eight parameters are:

$H$ = The number of recesses on the stationary housing (the same as the number of convex corners);

$P$ = The number of lobes on the piston (the same as the number of convex corners);

$R$ = Minimum interior radius of the housing (the same as the piston curve profile generating radius);

$e$ = The eccentricity of the rotary piston;

$D_0$ = Fixed circle diameter of the stationary housing;

$D_1$ = Rolling circle diameter of the stationary housing;

$D_2$ = Fixed circle diameter of the rotary piston; and $D_3$ = Rolling circle diameter of the rotary piston.

In essence, the relationship between the piston profile and the housing profile can be described in terms of five independant equations in eight unknowns. It is deductable from elementary simultaneous equation mathematics, that if any three of the eight unknowns are known or given, then the other five perimeters can be derived from the five independant relationships. For example:

Given that:

$R = 10$ inches;

$e = 2$ inches; and $P = 3$ it is then possible to solve for the remaining values of H, $D_0$, $D_1$, $D_2$ and $D_3$ as follows:

STATIONARY HOUSING PARAMETERS

1. $H = P + 1$

1a. $H = 3 + 1 = 4$

2. $D_0 = \frac{2 \cdot (R + e) \cdot H}{H + 1}$

2a. $D_0 = \frac{2 \cdot (10 + 2) \cdot 4}{4 + 1} = 19{,}2$ inches.

3. $D_1 = \frac{2 \cdot (R + e)}{H + e}$

3a. $D_1 = \frac{2 \cdot (10 + 2)}{4 + 1} = 4{,}8$ inches.

4. $H = D_0/D_1$

4a. $H = \frac{19{,}2}{4{,}8} = 4$

5. $R + e = \frac{D_0 + D_1}{2}$

5a. $R + e = \frac{19{,}2 + 4{,}8}{2} = 12$ inches.

Where $H$ = The number of recesses on the stationary housing.

$D_0$ = Fixed circle diameter of the stationary housing.

$D_1$ = Rolling circle diameter of the stationary housing.

$R + e$ = Generating radius of the stationary housing curve profile.

ROTARY PISTON PARAMETERS

1. $P = H - 1$

1a. $P = 4 - 1 = 3$

2. $D_2 = \frac{2 \cdot P \cdot R}{P + 1}$

2a. $D_2 = \frac{2 \cdot 3 \cdot 10}{3 + 1} = 15$ inches.

-continued

3. $D_3 = \frac{2 \cdot R}{P+1}$

3a. $D_3 = \frac{2 \cdot 10}{3+1} = 5$ inches.

4. $P = D_2/D_3$

4a. $P = 15/5 = 3$

5. $R = \frac{D_2 + D_3}{2}$

5a. $R = \frac{15+5}{2} = 10$ inches.

Where $P$ = The number of lobes on the rotary piston.

$D_2$ = Fixed circle diameter of the rotary piston.

$D_3$ = Rolling circle diameter of the rotary piston.

$R$ = Generating radius of the rotary piston curve profile.

Q.E.D.

In actual practice, it has been found that many of the parameters may be given by the circumstances surrounding the use of the engine. For instance, if low horse power or small sizes necessary, then the ultimate diameter of the housing will be a known factor. Additionally, for a variety of reasons, it may be desirable to build a piston with a minimum number of lobes. For instance, in order to cut down on unnecessary ignition circuits and manufacturing costs, it may be desirable to build the engine with only four housing recesses as illustrated in FIGS. 1 – 4. Another factor, that may be given, is the desired compression factor which in turn is related to an optimum $R/e$ ratio. Therefore, for a given engine size and horsepower and for a desired compression ratio, it is possible to construct a rotary piston engine having the optimal piston to housing profile.

It is evident that in creating the stationary housing curve profile, the generating radius $R_1 = R + e$ and the required eccentricity e of the rotary piston are primary factors. The rolling circle with $D_1$ diameter as it constantly follows the circle resulted from the generating radius $R_1 = R + e$ dictates the proper positions of the generating point $P_h(x_h,y_h)$. In other words if the generating radius $R_1$ is designated a hypotenuse with an angle h relative to the origin O of the cartesian coordinate system, then the eccentricity e of the rotary piston as a second generating radius becomes a hypotenuse with an angle $\alpha_{h1}$ relative to the center of the rolling circle with $D_1$ diameter and determines the proper positions of the generating point $P_h(x_h,y_h)$ on the stationary housing curve profile C in a cartesian coordinate system. Each position of the generating point $p_h(x_h,y_h)$ has a suitable angle $\alpha_h$ and $\alpha_{h1}$. The following equation discloses how $\alpha_h$ and $\alpha_{h1}$ are computed:

$$\alpha_h = \frac{\alpha_{h1}}{H+1} \quad (12)$$

$$\alpha_{h1} = (H+1) \cdot \alpha_h \quad (13)$$

Where $\alpha_h$ = generating angle with the hypotenuse of the generating radius $R_1 = R + e$ $\alpha_{h1}$ = generating angle with the hypotenuse of the eccentricity e of the rotary piston.

The following equations disclose the preferred relationship between the fixed, stationary circle with $D_0$ diameter and the rolling circle with $D_1$ diameter in connection with related parameters:

$$D_0 = \frac{2 \cdot R_1 \cdot H}{H+1} \quad (14)$$

$$D_o = H \cdot D_1 \quad (15)$$

$$D_1 = D_o/H \quad (16)$$

$$R_1 = \frac{D_0 + D_1}{2} \quad (17)$$

$$R = R_1 - e \quad (18)$$

$$e = R_1 - R \quad (19)$$

$$H = D_o/D_1 \quad (20)$$

Where $D_o$= Diameter of the fixed, stationary circle, for stationary housing;

$D_1$= Diameter of the rolling circle, for stationary housing;

$R_1 = R + e$ = Stationary housing curve profile generating radius;

$R$ = Rotary piston curve profile generating radius;

$e$ = Eccentricity of the rotary piston;

$H$ = Number of the geometrical convex recesses of the stationary housing.

The following equations disclose the relationship of $x_h$ and $y_h$ to the cartesian coordinate system:

$$x_h = \cos \alpha_h \cdot R_1 + \cos \alpha_{h1} \cdot e \quad (21)$$

$$x_h = \cos \alpha_h \cdot (R + e) + \cos (H+1)\alpha_h \cdot e \quad (22)$$

$$y_h = \sin \alpha_h \cdot R_1 + \sin \alpha_{h1} \cdot e \quad (23)$$

$$y_h = \sin \alpha_h \cdot (R + e) + \sin (H+1)\alpha_h \cdot e \quad (24)$$

$$\alpha_h = 0° \text{ to } 360° \quad (25)$$

$$\alpha_{h1} = (H+1) \cdot \alpha_h = 0° \text{ to } (H \cdot 360° + 360°) \quad (26)$$

Where $y_h$ = Abscissa, function;

$y_h$ = Ordinate, function;

$\alpha_h$ = Generating angle with the hypotenuse of the generating radius $R_1 = R + e$ . ;

$\alpha_{h1}$ = Generating angle with the hypotenuse of the eccentricity $e$ of the rotary piston;

$R$ = Rotary piston curve profile generating radius;

$R_1$ = Stationary housing curve profile generating radius;

$e$ = Eccentricity of the rotary piston.

The following explanation and relationships will show how to develop the area $A_h$ of the stationary housing. From the preceding explanation and relationships, it is evident that a point $p_h(x_h,y_h)$ on the stationary housing curve profile is a function of $x_h$ and $y_h$. The foregoing relationships disclose the positions of the point $p_h(x_h,y_h)$ which can be described in terms of a triangle with abscissa $x_h$ and ordinate $y_h$ or a hypotenuse of polar radius $y_h$ with an angle $\theta_h$ relative to the origin 0. The equations of the triangle are the following:

$$\sin \theta_h = y_h/r_h \quad (27)$$

$$\cos \theta_h = x_h/r_h \quad (28)$$

$$r_h = y_h/\sin \theta_h \quad (29)$$

$$r_h = x_h/\cos \theta_h \quad (30)$$

$$r_h = \sqrt{x_h^2 + y_h^2} \quad (31)$$

$$r_h = [R_1^2 + e^2 + 2 \text{ Re} \cos \text{HaH}]^{1/2} \quad (32)$$

Where $\theta_h$ = Polar angle.

$r_h$ = Hypotenuse or polar radius.

$x_h$ = Abscissa, function.

$y_h$ = Ordinate, function.

The following relationships disclose the area $A_h$ of the stationary housing of a rotary piston engine with multi-explosion chambers:

$$A_h = \tfrac{1}{2} \cdot \int_0^{2\pi} (x_h^2 + y_h^2)\, d\theta_h \quad (33)$$

$$A_h = \tfrac{1}{2} \cdot \int_0^{2\pi} \left(\frac{y_h}{\sin \theta_h}\right)^2 d\theta_h \quad (34)$$

$$A_h = \tfrac{1}{2} \cdot \int_0^{2\pi} \left(\frac{x_h}{\cos \theta_h}\right)^2 d\theta_h \quad (35)$$

$$A_h = \tfrac{1}{2} \cdot \int_0^{2\pi} r_h^2\, d\theta_h \quad (36)$$

$$A_h = \tfrac{1}{2} \cdot \int_0^{2\pi} R_1^2 + e^2 + 2 \cdot R_1 \cdot e \cdot \cos(H\alpha_h)\, d\theta_h \quad (37)$$

The following relationships disclose the area $A_{hs}$ of the circular section of the stationary housing:

$$A_{hs} = \tfrac{1}{2} \cdot \int_{\theta_{1h}}^{\theta_{2h}} (x_h^2 + y_h^2)\, d\theta_h \quad (38)$$

$$A_{hs} = \tfrac{1}{2} \cdot \int_{\theta_{1h}}^{\theta_{2h}} \left(\frac{y_h}{\sin \theta_h}\right)^2 d\theta_h \quad (39)$$

$$A_{hs} = \tfrac{1}{2} \cdot \int_{\theta_{1h}}^{\theta_{2h}} \left(\frac{x_h}{\cos \theta_h}\right)^2 d\theta_h \quad (40)$$

$$A_{hs} = \tfrac{1}{2} \cdot \int_{\theta_{1h}}^{\theta_{2h}} r_h^2\, d\theta_h \quad (41)$$

$$A_{hs} = \tfrac{1}{2} \cdot \int_{\theta_{1h}}^{\theta_{2h}} R_1^2 + e^2 + 2 \cdot R_1 \cdot e \cdot \cos(H\alpha_h)\, d\theta \quad (42)$$

Where $\theta_h$ = Polar angle.

$\theta_{1h}$ = Circular sectors angle, lower limit.

$\theta_{2h}$ = Circular sectors angle, upper limit.

The equations below disclose the lengths of the curve profile $S_h$ of the stationary housing:

$$S_h = \int_0^{2\pi} (x_h^2 + y_h^2) + \left(\frac{d\sqrt{x_h^2 + y_h^2}}{d\theta_h}\right)^2 d\theta_h \quad (43)$$

$$S_h = \int_0^{2\pi} \left(\frac{y_h}{\sin \theta_h}\right)^2 + \left(\frac{d \frac{y_h}{\sin \theta_h}}{d\theta_h}\right)^2 d\theta_h \quad (44)$$

$$S_h = \int_0^{2\pi} \left(\frac{x_h}{\cos \theta_h}\right)^2 + \left(\frac{d \frac{x_h}{\cos \theta_h}}{d\theta_h}\right)^2 d\theta h \quad (45)$$

$$S_h = \int_0^{2\pi} r^2 + \left(\frac{d r_h}{d\theta_h}\right)^2 d\theta_h \quad (46)$$

$$S_h = \int_0^{2\pi} R_1^2 + e^2 + 2 \cdot R_1 \cdot e \cdot \cos(H\alpha) + \left(\frac{d r_h}{d\theta_h}\right)^2 d\theta_h \quad (47)$$

The following equations disclose the lengths of the curve profile $S_{hs}$ of the circular section of the stationary housing:

$$S_{hs} = \int_{\theta_{1h}}^{\theta_{2h}} (x_h^2 + y_h^2) + \left(\frac{d\sqrt{x_h^2 + y_h^2}}{d\theta_h}\right)^2 d\theta_h \quad (48)$$

$$S_{hs} = \int_{\theta_{1h}}^{\theta_{2h}} \left(\frac{y_h}{\sin \theta_h}\right)^2 + \left(\frac{d \frac{y_h}{\sin \theta_h}}{d\theta_h}\right)^2 d\theta_h \quad (49)$$

$$S_{hs} = \int_{\theta_{1h}}^{\theta_{2h}} \left(\frac{x_h}{\cos \theta_h}\right)^2 + \left(\frac{d \frac{x_h}{\cos \theta_h}}{d\theta_h}\right)^2 d\theta_h \quad (50)$$

$$S_{hs} = \int_{\theta_{1h}}^{\theta_{2h}} rh^2 + \left(\frac{d r_h}{d\theta_h}\right)^2 d\theta_h \quad (51)$$

-continued $$S_{hk} = \int_{\theta_{1h}}^{\theta_{2h}} R_1^2 + e^2 + 2 \cdot R_1 \cdot e \cdot \cos(H\alpha) + \left(\frac{d\, r_h}{d\, \theta_h}\right)^2 d\, \theta_h \quad (52)$$

The transverse cross-sectional detail view of the multi-shaped rotary piston profile (FIG. 3) illustrates an algebraic curve of high degree.

According to FIG. 3, an algebraic curve of high degree will be constructed by using a fixed, stationary circle with $D_2$ diameter and a rolling circle with $D_3$ diameter. In the rolling circle with $D_3$ diameter, a point $P_p(x_p, y_p)$ will be chosen if the rolling circle with $D_3$ diameter is rolled around the outside of the stationary circle with $D_2$ diameter without sliding, then the point $p_p(x_p, y_p)$ creates an algebraic curve of high degree.

When the choisen point $p_p(x_p, y_p)$ is on the circumference of the rolling circle with $D_3$ diameter, then the curve $C_1$ generated by the rolling circle with $D_3$ diameter as it rolls on the exterior of the fixed circle with $D_2$ diameter is called an epicycloid.

If the generating point $p_p(x_p, y_p)$ is within the circumference of the rolling circle with $D_3$ diameter, then the curve $C_1$ generated is called an epitrochoid.

Therefore, if:

$$\frac{D_2}{D_3} = \frac{R - e}{e} = \frac{R_2}{e} = K_2 \quad (53)$$

then the curve $C_1$ is called an epicycloid.

If:

$$\frac{D_2}{D_3} < \left(\frac{R - e}{e} = \frac{R_2}{e} = K_2\right) \quad (54)$$

then the curve $C_1$ is called an epitrochoid.

Where:

$D_2$ = Fixed, stationary circle, for rotary piston curve profile;

$D_3$ = Rolling circle, for rotary piston curve profile;

$R$ = Rotary piston curve profile generating radius;

$e$ = Eccentricity of the rotary piston;

$K_2$ = Ratio factor.

In general terms where $p \leqq 7$ the rotary piston curve profile should be constructed using the method for an epitrochoid. If $p \geqq 8$ then the rotary piston curve profile could be constructed using the method for an epicycloid, taking into consideration other technical and economic facts.

The following summarizes facts about the K, $K_1$ and $K_2$ ratios relative to other parameters:

$$K = \frac{R}{e} \quad (55)$$

$$K_1 = \frac{R_1}{e} = \frac{R + e}{e} \quad (56)$$

$$K_2 = \frac{R_2}{e} = \frac{R - e}{e} \quad (57)$$

Where:

$K$ = Ratio factor, middle;

$K_1$ = Ratio factor, upper;

$K_2$ = Ratio factor, lower;

$R$ = Rotary piston curve profile generating radius;

$R_1$ = Stationary housing curve profile generating radius;

$R_2$ = Differential radius;

$e$ = Eccentricity of the rotary piston.

It is therefore clear that $K_1 > K > K_2$.

The ratio factors K, $K_1$ and $K_2$ are used to refer to a graduation of ratios which mathmatically dictate restrictions on the compression ratio E. The ratio factors are also determined by the curve profiles of the stationary housing and the rotary pistons as well as by the practical limits inherent in internal combustion engines.

Using the above facts, the following relationships can be computed:

$$K = K_1 - 1 = K_2 + 1 = \frac{K_1 + K_2}{2} \quad (58)$$

$$K_1 = K + 1 = K_2 + 2 \quad (59)$$

$$K_2 = K - 1 = K_1 - 2 \quad (60)$$

It is evident, that in creating the rotary piston curve profile, the generating radius R and the required eccentricity e of the rotary piston are primary factors. As the rolling circle with $D_3$ diameter follows the circle resulting from the generating radius R, the rotary piston curve profile is dictated by generating point $p_p(x_p, y_p)$ with the eccentricity e of the rotary piston as a second generating radius. In other words, if the generating radius R is designated a hypotenuse with an angle $\alpha_p$ relative to the origin $O_1$ of the cartesian coordinate system, and the eccentricity e of the rotary piston as a second generating radius is designated a hypotenuse with an angle $\alpha_{p1}$, a curve $C_1$ may be generated by the locus of points $p_p(x_p, y_p)$. Each position of the generating point $p_p(x_p, y_p)$ has a corresponding angle $\alpha_p$ and an angle $\alpha_{p1}$. The following equations disclose how it is computed:

$$\alpha_p = \frac{\alpha_{p1}}{P + 1} \quad (61)$$

$$\alpha_{p1} = (P + 1) \cdot \alpha_p \quad (62)$$

Where:

$\alpha_p$ = Generating angle with the hypotenuse of the generating radius R;

$\alpha_{p1}$ = Generating angle with the hypotenuse of the eccentricity e of the rotary piston.

The following equations are developed for describing the fixed, stationary circle with $D_2$ diameter and the rolling circle with $D_3$ diameter with respect to related factors:

$$D_2 = \frac{2 \cdot R \cdot P}{P + 1} \quad (63)$$

$$D_2 = P \cdot D_3 \quad (64)$$

$$D_3 = \frac{2 \cdot R}{P + 1} \quad (65)$$

$$D_3 = D_2/P \quad (66)$$

$$R = \frac{D_2 + D_3}{2} \quad (67)$$

$$R_1 = R + e \quad (68)$$

$$R_2 = R - e = R_1 - 2 \cdot e \quad (69)$$

$$e = \frac{R_1 - R_2}{2} \quad (70)$$

$$P = D_2/D_3 \quad (71)$$

Where:

$D_2$ = Fixed, stationary circle, for rotary piston;
$D_3$ = Rolling circle, for rotary piston;
$R$ = Rotary piston curve profile generating radius;
$R_1$ = Stationary housing curve profile generating radius;
$R_2$ = Differential radius;
$e$ = Eccentricity of the rotary piston;
$P$ = Number of the geometrical convex corners of the rotary piston.

The equations below describe functions of $x_p$ and $y_p$:

$$x_p = \cos \alpha_p \cdot R + \cos \alpha_{p1} \cdot e \quad (72)$$

$$x_p = \cos \alpha_p \cdot R + \cos (P + 1) \alpha_p \cdot e \quad (73)$$

$$y_p = \sin \alpha_p \cdot R + \sin \alpha_{p1} \cdot e \quad (74)$$

$$y_p = \sin \alpha_p \cdot R + \sin (P + 1) \alpha_p \cdot e \quad (75)$$

$$\alpha_p = 0° \text{ to } 360° \quad (76)$$

$$\alpha_{p1} = (P + 1) \cdot \alpha_p = 0° \text{ to } (P \cdot 360° + 360°) \quad (77)$$

Where:

$x_p$ = Abscissa, function;
$y_p$ = Ordinate, function;
$\alpha_p$ = Generating angle with the hypotenuse of the generating radius R;
$\alpha_{p1}$ = Generating angle with the hypotenuse of the eccentricity e of the rotary piston;
$R$ = Rotary piston curve profile generating radius;
$e$ = Eccentricity of the rotary piston.

The following explanation and relationships disclose the area $A_p$ of the rotary piston in a rotary piston engine with multi-explosion chambers. From the preceding explanation and the corresponding relationships it is evident that the point $p_p(x_p, y_p)$ on the rotary piston curve profile is a function of $x_p$ and $y_p$. The foregoing equations describe the positions of the point $p_p(x_p, y_p)$ which form a triangle with abscissa $x_p$ and which may be described as an ordinate $y_p$ hypotenuse or the polar radius $r_p$ with an angle $\theta_p$ relative to the origin $O_1$. The relationships of this triangle are as follows:

$$\sin \theta_p = y_p/r_p \quad (78)$$

$$\cos \theta_p = x_p/r_p \quad (79)$$

$$r_p = y_p/\sin \theta_p \quad (80)$$

$$r_p = x_p/\cos \theta_p \quad (81)$$

$$r_p = \sqrt{x_p^2 + y_p^2} \quad (82)$$

$$r_p = [R^2 + e^2 + 2.R.e.\cos (p\alpha_p)]^{1/2} \quad (83)$$

where:

$\theta_p$ = Polar angle.

$r_p$ = Hypotenuse or polar radius.

$x_p$ = Abscissa, function.

$y_p$ = Ordinate, function.

Figure 5:
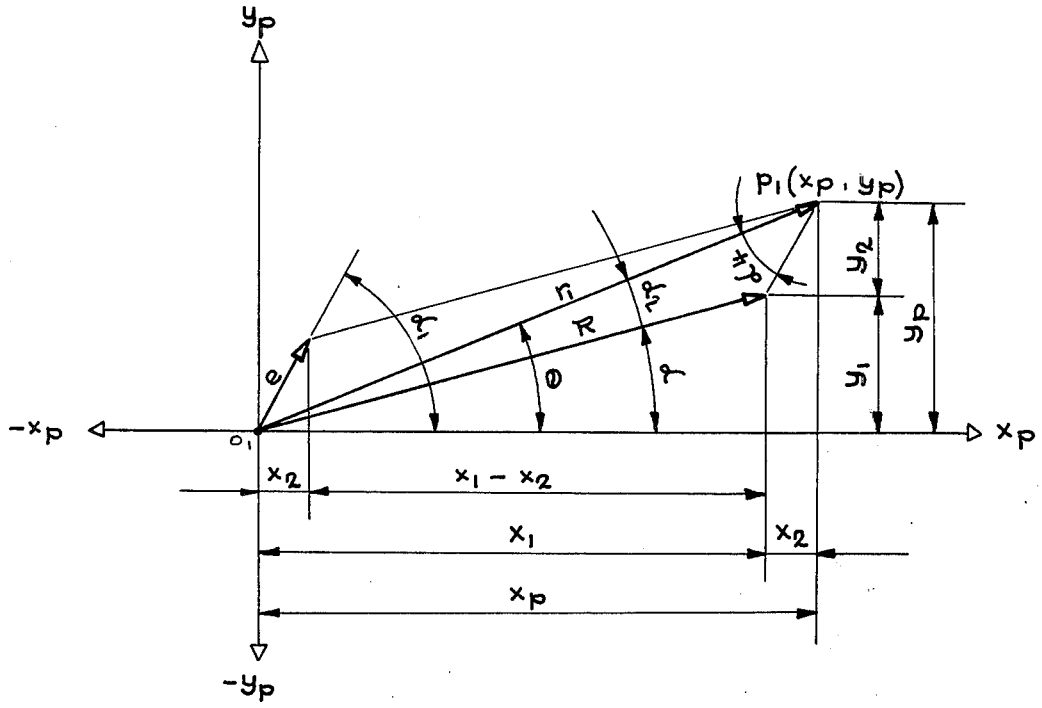
FIG. 5 is a vector diagram of the locus of the point $p_p(x_p, y_p)$.
Figure 6:
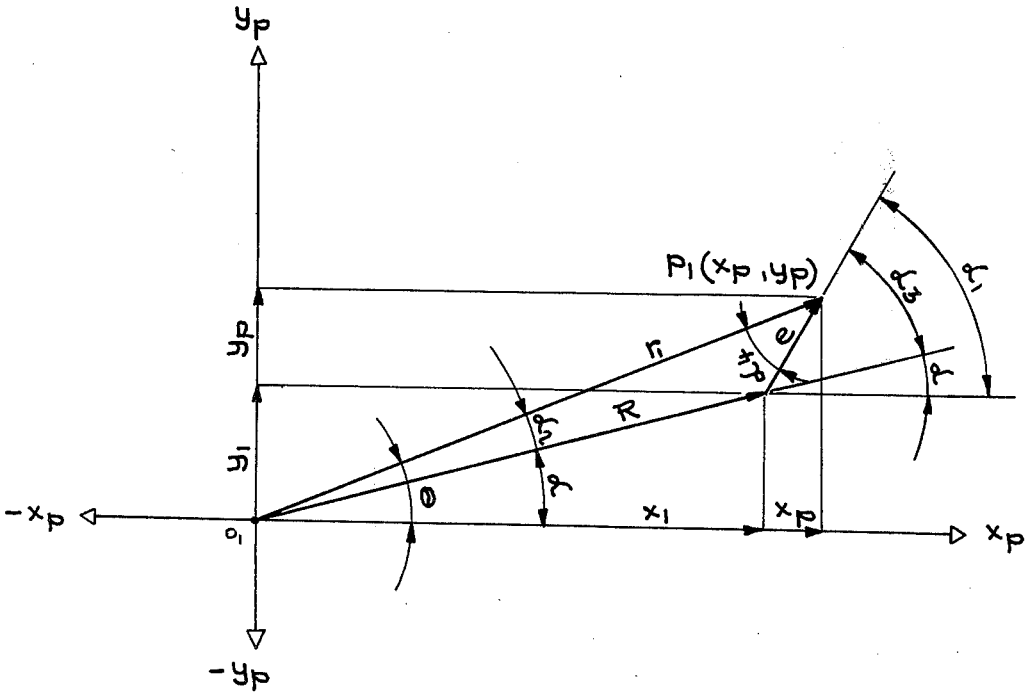
FIG. 6 is a simplified version of the diagram in FIG. 5.

FIG. 5 is a diagram of the vectors associated with the point $p_p(x_p, y_p)$. The point $p_p(x_p, y_p)$ is located at the tip of polar radius vector $r_p$. Vector $r_1$ is the resultant vector of the generating radius vector R and the piston excentricity vector e. FIG. 6 is a simplified version of FIG. 5. From the foregoing relationships it is relatively easy to define other (3o) relationships as follows:

KNOWN FACTORS: R, e, P, $\theta O_p$

UNKNOWN FACTORS: $r_1$, $\alpha_p$, ( $\alpha_{p1}$, $\alpha_2$, $\alpha_3$, $\alpha_4$ )

1. $\alpha_p = \theta_p - \alpha_2$
2. $\alpha_{p1} = (P + 1) \cdot \alpha_p$
3. $\alpha_2 = \theta_p - \alpha_p$
4. $\alpha_3 = P \cdot \alpha_p$
5. $\alpha_4 = \alpha_{p1} - \theta_p$
6. $x_1 = R \cdot \cos \alpha_p$
7. $x_2 = e \cdot \cos \alpha_{p1}$
8. $y_1 = R \cdot \sin \alpha_p$
9. $y_2 = e \cdot \sin \alpha_{p1}$
10. $x_p = x_1 + x_2$
11. $y_p = y_1 + y_2$
12. $x_p = R \cdot \cos \alpha_p + e \cdot \cos \alpha_{p1}$
13. $y_p = R \cdot \sin \alpha_p + e \cdot \sin \alpha_{p1}$
14. $r_p = \sqrt{(x_1 + x_2)^2 + (y_1 + y_2)^2}$
15. $r_p = \sqrt{x_p^2 + y_p^2}$
16. $r_p = (R+e) - [R.(1-\cos \alpha_2) + e.(1-\cos \alpha_4)]$
17. $r_p = R \cdot \cos \alpha_2 + e \cdot \cos \alpha_4$
18. $r_p = R \cdot \left( \frac{1}{K} \cdot \cos \alpha_4 + \sqrt{1 - \frac{e^2}{R^2} \cdot \sin^2 - \alpha_4} \right)$
19. $r_p = \frac{R \cdot \sin (180° - \alpha_3)}{\sin \alpha_4}$
20. $r_p = \frac{R \cdot \sin \alpha_3}{\sin \alpha_4}$
21. $r_p = \frac{e \cdot \sin (180° - \alpha_3)}{\sin \alpha_2}$
22. $r_p = \frac{e \cdot \sin \alpha_3}{\sin a_2}$ -continued 23. $r_p^2 = (R + \cos \alpha_3 \cdot e)^2 + (\sin \alpha_3 \cdot e)^2$ 24. $r_p^2 = R^2 + 2 \cdot e \cdot (x_p^2 + y_p^2) \cos \alpha_4 - e^2$ 25. $r_p^2 = e^2 + 2 \cdot R (x_p^2 + y_p^2) \cos \alpha_2 - R^2$ 26. $r_p^2 = R^2 + e^2 + 2 \cdot R \cdot e \cdot \cos \alpha_3$ 27. $K = \frac{R}{e} = \frac{\sin \alpha_4}{\sin \alpha_2}$ 28. $\sin \alpha_2 = \frac{e \cdot \sin \alpha_4}{R}$ 29. $\sin \alpha_3 = \frac{r_p \cdot \sin \alpha_2}{e}$ 30. $\sin \alpha_4 = \frac{R \cdot \sin \alpha_2}{e}$ These relationships are developed for designing purposes and are accurate, as will be apparent to the reader from further consideration.

The following relationships disclose the area $A_p$ of the rotary piston:

$$A_p = \tfrac{1}{2} \cdot \int_0^{2\pi} (x_p^2 + y_p^2)\, d\theta_p \quad (84)$$

$$A_p = \tfrac{1}{2} \cdot \int_0^{2\pi} \left(\frac{y_p}{\sin \theta_p}\right)^2 d\theta_p \quad (85)$$

$$A_p = \tfrac{1}{2} \cdot \int_0^{2\pi} \left(\frac{x_p}{\cos \theta_p}\right)^2 d\theta_p \quad (86)$$

$$A_p = \tfrac{1}{2} \cdot \int_0^{2\pi} r_p^2\, d\theta_p \quad (87)$$

$$A_p = \tfrac{1}{2} \cdot \int_0^{2\pi} R^2 + e^2 + 2 \cdot R \cdot e \cdot \cos (P\alpha_p)\, d\theta_p \quad (88)$$

The following relationships describe the area $A_{ps}$ of the circular section of the rotary piston:

$$A_{ps} = \tfrac{1}{2} \cdot \int_{\theta_{1p}}^{\theta_{2p}} (x_p^2 + y_p^2)\, d\theta_p \quad (89)$$

$$A_{ps} = \tfrac{1}{2} \cdot \int_{\theta_{1p}}^{\theta_{2p}} \left(\frac{y_p}{\sin \theta_p}\right)^2 d\theta_p \quad (90)$$

$$A_{ps} = \tfrac{1}{2} \cdot \int_{\theta_{1p}}^{\theta_{2p}} \left(\frac{x_p}{\cos \theta_p}\right)^2 d\theta_p \quad (91)$$

$$A_{ps} = \tfrac{1}{2} \cdot \int_{\theta_{1p}}^{\theta_{2p}} r_p^2\, d\theta_p \quad (92)$$

$$A_{ps} = \tfrac{1}{2} \cdot \int_{\theta_{1p}}^{\theta_{2p}} R^2 + e^2 + 2 \cdot R \cdot e \cdot \cos (P\alpha_p)\, d\theta_p \quad (93)$$

Where $\theta_p$ = Polar angle.

$\theta_{1p}$ = Circular sectors angle, lower limit.

$\theta_{2p}$ = Circular sectors angle, upper limit.

The following describes the lengths of curve profile $S_p$ of the rotary piston:

$$S_p = \int_0^{2\pi} (x_p^2 + y_p^2) + \left(\frac{d\sqrt{x_p^2 + y_p^2}}{d\theta_p}\right)^2 d\theta_p \quad (94)$$

$$S_p = \int_0^{2\pi} \left(\frac{y_p}{\sin \theta_p}\right)^2 + \left(\frac{d \frac{y_p}{\sin \theta_p}}{d\theta_p}\right)^2 d\theta_p \quad (95)$$

$$S_p = \int_0^{2\pi} \left(\frac{x_p^2}{\cos \theta_p}\right)^2 + \left(\frac{d \frac{x_p}{\cos \theta_p}}{d\theta_p}\right)^2 d\theta_p \quad (96)$$

$$S_p = \int_0^{2\pi} r_1^2 + \left(\frac{d r_p}{d\theta_p}\right)^2 d\theta_p \quad (97)$$

$$S_p = \int_0^{2\pi} R^2 + e^2 + 2 \cdot R \cdot e \cdot \cos (P\alpha) + \left(\frac{d r_p}{d\theta_p}\right)^2 d\theta_p \quad (98)$$

The following equation describes the length of curve profile $S_{ps}$ of the circular section:

$$S_{ps} = \int_{\theta_{1p}}^{\theta_{2p}} (x_p^2 + y_p^2) + \left(\frac{d\sqrt{x_p^2 + y_p^2}}{d\theta_p}\right)^2 d\theta_p \quad (99)$$

$$S_{ps} = \int_{\theta_{1p}}^{\theta_{2p}} \left(\frac{y_p}{\sin \theta_p}\right)^2 + \left(\frac{d \frac{y_p}{\sin \theta_p}}{d\theta_p}\right)^2 d\theta_p \quad (100)$$

$$S_{ps} = \int_{\theta_{1p}}^{\theta_{2p}} \left(\frac{x_p}{\cos \theta_p}\right)^2 + \left(\frac{d \frac{x_p}{\cos \theta_p}}{d\theta_p}\right)^2 d\theta_p \quad (101)$$

$$S_{ps} = \int_{\theta_{1p}}^{\theta_{2p}} r_p^2 + \left(\frac{d r_1}{d\theta_p}\right)^2 d\theta_p \quad (102)$$

$$S_{ps} = \int_{\theta_{1p}}^{\theta_{2p}} R^2 + e^2 + 2 \cdot R \cdot e \cdot \cos (P\alpha_p) + \left(\frac{d r_p}{d\theta_p}\right)^2 d\theta_p \quad (103)$$

The relationships below discloses the total area $A_w$ of all of the working chambers created by the rotation in the stationary housing of the rotary piston engine with multi-explosion chambers:

$$A_w = A_h - A_p \quad (104)$$

Where $A_w$ = Total area of all of the working chambers.

$A_h$ = Area of the stationary housing.

$A_p$ = Area of the rotary piston.

The following equations disclose minimum area $A_{min}$ of any of the working chambers, created by the rotary piston in determined positions in the stationary housing. In order to develop the minimum area $A_{min}$, the coordinate axes $x_h$ and $y_h$ of the stationary housing curve profile must be translated. To understand the mode of the translations of the coordinate axes $x_h$ and $y_h$, reference is made to FIG. 4 wherein the coordinate axes $x_p$ and $y_p$ of the rotary piston curve profile and the coordinate axes $x_h$ and $y_h$, $x_{h2}$ and $y_{h2}$, $x_{h3}$ and $y_{h3}$ of the statonary housing curve profile are illustrated.

The following equations disclose the relationship between the coordinate equations of the rotary piston curve profile and the stationary housing curve profile. These are the basic coordinate equations:

$$x_p = \cos \alpha_p \cdot R + \cos (P+1) \alpha_p \cdot e \quad (105)$$

$$y_p = \sin \alpha_p \cdot R + \sin (P+1) \alpha_p \cdot e \quad (106)$$

$$x_h = \cos \alpha_h \cdot (R+e) + \cos (H+1) \alpha_h \cdot e \quad (107)$$

$$y_h = \sin \alpha_h \cdot (R+e) + \sin (H+1) \alpha_h \cdot e \quad (108)$$

As part of the previously mentioned translation, the coordinate axes $x_h$ and $y_h$ of the stationary housing curve profile will be translated to coordinate axes $x_{h2}$ and $y_{h2}$ about an angle $\gamma$. The angle $\gamma$ is a translational angle defined as the twist of the $x_{h2}$, $y_{h2}$ frame of reference with respect to the $x_h$ and $y_h$ frame of reference. This will result in a twsit translation of the coordinated axes $x_h$ and $y_h$ to the coordinate axes $x_{h2}$ and $y_{h2}$, and transformation of the coordinate equations $x_h$ and $y_h$ to the coordinate equations $x_{h2}$ and $y_{h2}$, as follows:

$$\gamma = \frac{360°}{2 \cdot H} \quad (109)$$

$$x_{h2} = \cos \alpha_h \cdot (R+e) - \cos (H+1) \alpha_h \cdot e \quad (110)$$

$$y_{h2} = \sin \alpha_h \cdot (R+e) - \sin (H+1) \alpha_h \cdot e \quad (111)$$

Where:

$\gamma$ = Translation angle between the coordinate axes $x_h$ and $x_{h2}$ respectively $y_h$ and $y_{h2}$ of the stationary housing curve profile, $H$ = Number of the geometrical convex recesses of the stationary housing;

$x_{h2}$ = Transformed coordinate equation of $x_h$ by the twist translation of the coordinate axis $x_h$ to the coordinate axis $x_{h2}$;

$y_{h2}$ = Transformed coordinate equation of $y_h$ by the twist translation of the coordinate axis to the coordinate axis $y_{h2}$.

As another part of the previously mentioned translations, the origin O of the stationary housing curve profile will be translated along an angle $\gamma_1$ and with a distance $e$ to the origin $\mathbf{0}_1$ of the rotary piston curve profile. This will result in a linear translation of the coordinate axis $x_{h2}$ to the coordinate axis $x_{h3}$ and a parallel translation of the coordinate axis $y_{h2}$ to the coordinate axis $y_{h3}$ and transformation of the coordinate equations $x_{h2}$ and $y_{h2}$ to the coordinate equations $x_{H3}$ and $y_{h3}$, as follows:

$$\gamma_1 = 180° = \text{constant} \quad (112)$$

$$x_{h3} = x_{h2} + \cos \gamma_1 \cdot e \quad (113)$$

$$y_{h3} = y_{h2} \cdot \cos \gamma_1 \quad (114)$$

Where:

$\gamma_1$ = Translation angle between the origin $\mathbf{0}$ of the stationary housing curve profile and the origin $\mathbf{0}_1$ of the rotary piston curve profile;

$e$ = Eccentricity of the rotary piston;

$x_{h3}$ = Transformed coordinate equation of $x_{h2}$, by the linear translation of the coordinate axis $x_{h2}$ to the coordinate axis $x_{h3}$;

$y_{h3}$ = Transformed coordinate equation of $y_{h2}$, by the parallel translation of the coordinate axis $y_{h2}$ to the coordinate axis $y_{h3}$.

Further relationships may be developed as follows. These equations assist to determine the lower limit of integration.

$$\gamma_2 = \frac{360°}{2 \cdot P} \quad (116)$$

$$\tan \gamma_3 = \frac{S_D}{R+e} \quad (116)$$

$$\gamma_4 = \gamma_2 - \gamma_3 \quad (117)$$

Where:

$\gamma_2$ = Half of the actual angle between the center line of the rotary piston lobes;

$\gamma_3$ = A suitable angle between the outside of the S seal strip (23) and the center line of the rotary piston lobe;

$\gamma_4$ = Half of the effective circular sections angle;

$P$ = Number of the geometrical convex lobes of the rotary piston;

$S_D$ = Seal strips S(23) outside distance from the center line of the rotary piston lobes;

$R$ = Rotary piston curve profile generating radius;

$e$ = Eccentricity of the rotary piston.

The following equation describes the lower limits $\beta$ of integration of the function $x_{h3}^2 + y_{h3}^2$ of the stationary housing circular section area and the function $x_p^2 + y_p^2$ of the rotary piston circular section area.

$$\beta = \gamma_1 - \gamma_4 \quad (118)$$

Where:

$\beta$ = Lower limits of integrations of the function $x_{h3}^2 + y_{h3}^2$ of the stationary housing circular section area and the function $x_p^2 + y_p^2$ of the rotary piston circular section area.

The following explanation and corresponding relationships disclose how to describe in the minimum area $A_{min}$ of any of the working chambers created by the eccentrically rotated rotary piston curve profile surface, limited by the seal strips S(23). From the preceding explanation and the relevant equations, it is evident that a point $p_{h3}$ ($x_{h3}$, $y_{h3}$) of the stationary housing curve profile is a function of $x_{h3}$ and $y_{h3}$. The foregoing equations disclose the positions of the point $p_{h3}$ ($x_{h3}$, $y_{h3}$) which in fact forms a triangle with abscissa $x_{h3}$, ordinate $y_{h3}$ or can be described by a hypotenuse or polar radius $r_{h3}$, with an angle $\theta_{h3}$ relative to the origin $\mathbf{0}_1$. The relationships of this triangle are the following:

$$\sin \theta_{h3} = \frac{y_{h3}}{r_{h3}} \quad (119)$$

$$\cos \theta_{h3} = \frac{x_{h3}}{r_{h3}} \quad (120)$$

$$r_{h3} = \frac{y_{h3}}{\sin \theta_{h3}} \quad (121)$$

$$r_{h3} = \frac{x_{h3}}{\cos \theta_{h3}} \quad (122)$$

$$r_{h3} = \sqrt{x_{h3}^2 + y_{h3}^2} \quad (123)$$

Where:

$\theta_{h3}$ = Polar angle;

$r_{h3}$ = hypotenuse or polar radius;

$x_{h3}$ = Abscissa, function;

$y_{h3}$ = Ordinate, function.

-continued $$A_{min} = \int_{\beta}^{\pi} (x_{h3}^2 + y_{h3}^2)\, d\,\theta_{h3} - \int_{\beta}^{\pi} (x_p^2 + y_p^2)\, d\,\theta_p \quad (124)$$

$$A_{min} = \int_{\beta}^{\pi} \left(\frac{y_{h3}}{\sin\theta_{h3}}\right)^2 d\,\theta_{h3} - \int_{\beta}^{\pi} \left(\frac{y_p}{\sin\theta_p}\right)^2 d\,\theta_p \quad (125)$$

$$A_{min} = \int_{\beta}^{\pi} \left(\frac{x_{h3}}{\cos\theta_{h3}}\right)^2 d\,\theta_{h3} - \int_{\beta}^{\pi} \left(\frac{x_p}{\cos\theta_p}\right)^2 d\,\theta_p \quad (126)$$

$$A_{min} = \int_{\beta}^{\pi} r_{h3}^2\, d\,\theta_{h3} - \int_{\beta}^{\pi} r_p^2\, d\,\theta_p \quad (127)$$

The following equations describe the maximum area $A_{max}$ of any of the working chambers created by the rotary piston in determined positions and by the eccentric rotations of the rotary piston in the stationary housing. In order to describe the maximum area $A_{max}$, the coordinate axes $x_h$ and $y_h$ of the stationary housing curve profile must be translated. To better understand the mode of this translation of coordinate axes $x_h$ and $y_h$, reference is made to FIG. 1 where the coordinate axes $x_p$ and $y_p$ of the rotary profile and the coordinate axes $x_h$ and $y_h$, $x_{h1}$ and $y_{h1}$ of the stationary housing curve profile are illustrated.

As part of the previously mentioned translation of the coordinate axes $x_h$ and $y_h$, the origin O of the stationary housing curve profile will be translated along an angle $\gamma_1$ and with a distance e to the origin $O_1$ of the rotary piston curve profile. This will result a linear translation of the coordinate axis $x_h$ to the coordinate axis $x_{h1}$ and in a parallel translation of the coordinate axis $y_h$ to the coordinate axis $y_{h1}$, and transformation of the coordinate equations $x_h$ and $y_h$ to the coordinate equations $x_{h1}$ and $y_{h1}$ as follows:

$$x_{h1} = x_h - \cos\gamma_1 \cdot e \quad (128)$$

$$y_{h1} = y_h \cdot \cos\gamma_1 \quad (129)$$

Where:

$\gamma_1$ = Translation angle between the origin O of the stationary housing curve profile and the origin $O_1$ of the rotary piston curve profile;

$x_{h1}$ = Transformed coordinate equation of $x_h$, by the linear translation of the coordinate axis $x_h$ to the coordinate axis $x_{h1}$.

$y_{h1}$ = Transformed coordinate equation of $y_h$, by the parallel translation of the coordinate axis $y_h$ to the coordinate axis $y_{h1}$.

The following explanation and corresponding relationships describe the maximum area $A_{max}$ of any of the working chambers created by the eccentrically rotated rotary piston curve profile surface and limited by the seal strips S(23) within the stationary housing curve profile surface. From the preceding explanation and corresponding relationships it is evident that a point $P_{h1}$ ($x_{h1}$, $y_{h1}$) on the stationary housing curve profile is a function of $x_{h1}$ and $y_{h1}$. The foregoing relationships describe the positions of the point $P_{h1}$ ($x_{h1}$, $y_{h1}$) which in fact forms a triangle with abscissa $x_{h1}$, ordinate $y_{h1}$, and may be described by an hypotenuse of polar radius $r_{h1}$, with an angle $\theta_{h1}$ relative to the origin $O_1$. The relationships of this triangle are the following:

$$\sin\theta_{h1} = \frac{y_{h1}}{r_{h1}} \quad (130)$$

-continued $$\cos\theta_{h1} = \frac{x_{h1}}{r_{h1}} \quad (131)$$

$$r_{h1} = \frac{y_{h1}}{\sin\theta_{h1}} \quad (132)$$

$$r_{h1} = \frac{x_{h1}}{\cos\theta_{h1}} \quad (133)$$

$$r_{h1} \sqrt{x_{h1}^2 + y_{h1}^2} \quad (134)$$

Where:

$\theta_{h1}$ = Polar angle $r_{h1}$ = Hypotenuse or polar radius;

$x_{h1}$ = Abscissa, function;

$y_{h1}$ = Ordinate, function.

$$A_{max} = \int_{\beta}^{\pi} (x_{h1}^2 + y_{h1}^2)\, d\,\theta_{h1} - \int_{\beta}^{\pi} (x_p^2 + y_p^2)\, d\,\theta_p \quad (135)$$

$$A_{max} = \int_{\beta}^{\pi} \left(\frac{y_{h1}}{\sin\theta_{h1}}\right)^2 d\,\theta_{h1} - \int_{\beta}^{\pi} \left(\frac{y_p}{\sin\theta_p}\right)^2 d\,\theta_p \quad (136)$$

$$A_{max} = \int_{\beta}^{\pi} \left(\frac{x_{h1}}{\cos\theta_{h1}}\right)^2 d\,\theta_{h1} - \int_{\beta}^{\pi} \left(\frac{x_p}{\cos\theta_p}\right)^2 d\,\theta_p \quad (137)$$

$$A_{max} = \int_{\beta}^{\pi} r_{h1}^2\, d\,\theta_{h1} - \int_{\beta}^{\pi} r_p^2\, d\,\theta_p \quad (138)$$

From the preceeding coordinate relationships it is possible to determine the area $A_h$, the circular section area $A_{hs}$, the length of curve profile $S_h$ and the circular section of curve profile length $S_{hs}$ of the stationary housing of a rotary piston engine with multi explosion chambers. Further, the preceeding relationships demonstrate also how to determine the area $A_p$, the circular section area $A_{ps}$, the length of the curve profile $S_p$ and the circular section curve profile length $S_{ps}$ of the rotary piston.

Moreover, the preceeding relationships also describe how to determine the minimum area $A_{min}$, and the maximum area $A_{max}$ of the working chambers of a rotary piston engine with multi explosion chambers. The development of these coordinate equations was based on the fact that the number of the geometrical convex recesses H was an even number. As a result of the development of these coordinate equations, the number of the geometrical convex lobes P was an odd number.

If the number of geometrical convex recesses $H_1$ is an odd number, then the basic coordinate equations will be as follows:

$$x_{hu} = \cos\alpha_{hu} \cdot R_1 - \cos\alpha_{hu1} \cdot e \quad (139)$$

$$x_{hu} = \cos\alpha_{hu} \cdot (R + e) - \cos(H_1 + 1)\,\alpha_{hu} \cdot e \quad (140)$$

$$y_{hu} = \sin\alpha_{hu} \cdot R_1 - \sin\alpha_{hu1} \cdot e \quad (141)$$

$$y_{hu} = \sin\alpha_{hu} \cdot (R + e) - \sin(H_1 + 1)\,\alpha_{hu} \cdot e \quad (142)$$

As a result of the development of the above coordinate equations, the number of the geometrical convex lobes $P_1$ will be an even number and the basic coordinate equations will be as follows:

Continued $$x_{pu} = \cos \alpha_{pu} \cdot R - \cos \alpha_{pu1} \cdot e \quad (143)$$

$$x_{pu} = \cos \alpha_{pu} \cdot R - \cos (P_1 + 1) \alpha_{pu} \cdot e \quad (144)$$

$$y_{pu} = \sin \alpha_{pu} \cdot R - \sin \alpha_{pu1} \cdot e \quad (145)$$

$$y_{pu} = \sin \alpha_{pu} \cdot R - \sin (P_1 + 1) \alpha_{pu} \cdot e \quad (146)$$

The following relationships describe how to determine the minimum $V_{min}$ of any of the working chambers created by rotation of the piston within the stationary housing.

$$V_{min} = A_{min} \cdot W_h \quad (147)$$

$$W_h = \frac{R + e}{2} = \frac{R_1}{2} \quad (148)$$

Where:

$V_{min}$ = Minimum volume of any of the working chambers;

$A_{min}$ = Minimum area of any of the working chambers;

$W_h$ = Stationary housing width;

$R$ = Rotary piston curve profile generating radius;

$e$ = Eccentricity of the rotary piston.

The following relationships describe the maximum volume $V_{max}$ of any of the working chambers created by rotation of the piston within the stationary housing.

$$V_{max} = A_{max} \cdot W_p \quad (149)$$

$$W_p = \frac{R + e}{2} = \frac{R_1}{2} \quad (150)$$

Where:

$V_{max}$ = Maximum volume of any of the working chambers;

$A_{max}$ = Maximum area of any of the working chambers;

$W_p$ = Rotary piston width;

$R$ = Rotary piston curve profile generating radius;

$e$ = Eccentricity of the rotary piston.

The gearing system of this invention is described in detail in my U.S. Pat. No. 3,771,501, previously discussed. The details of U.S. Pat. No. 3,771,501 are hereby incorporated by reference into the disclosure of this invention in toto. Column 2, lines 14–47 clearly describe the gearing system that will be dealt with in exact detail below.

For reference, it will be appreciated from a review of U.S. Pat. No. 3,771,501 that:

$D_h$ = Diameter of internal gear element 29;

$D_p$ = Diameter of internal gear 28 affixed to the rotary piston;

$D_c$ = Diameter of planetary gear element 25;

$D_s$ = Diameter of output shaft gear element 24.

The transverse cross-sectional assembly view of the gearing system (FIG. 4) discloses the gearing layout of the rotary piston engine with multi explosion chambers. The gearing system has been developed to transmit power from the eccentrically rotated rotary piston to the output shaft. The gearing relationships will now be described and explained below:

$$D_h = 2 \cdot H \cdot e \quad (151)$$

$$D_h = D_p + 2 \cdot e \quad (152)$$

$$D_p = 2 \cdot 2 \cdot P \cdot e \quad (153)$$

$$D_p = D_h - 2 \cdot e \quad (154)$$

$$D_c = D_h/3 \quad (155)$$

$$D_c = \frac{2 \cdot H \cdot e}{3} = D_s \quad (156)$$

$$D_s = D_h/3 \quad (157)$$

$$D_s = \frac{2 \cdot H \cdot e}{3} = D_c \quad (158)$$

$$D_h/D_p = H/P = R_G \quad (159)$$

$$D_h/D_c = 3/1 = R_T = R_O \quad (160)$$

$$D_h/D_s = 3/1 = R_O = R_T \quad (161)$$

$$e = R_p = \frac{D_h - D_p}{} \quad (162)$$

$$e = R_p = \frac{D_h}{2 \cdot H} = \frac{D_p}{2 \cdot P} \quad (163)$$

$$H = \frac{D_h}{2 \cdot e} = P + 1 \quad (164)$$

$$H = \frac{D_p}{2 \cdot e} + 1 \quad (165)$$

$$P = \frac{D_p}{2 \cdot e} = H - 1 \quad (166)$$

$$P = \frac{D_h}{2 \cdot e} - 1 \quad (167)$$

$$D_e = 2 \cdot e \quad (168)$$

Where:

$D_h$ = Stationary housings internal gear diameter;

$D_p$ = Rotary pistons internal gear diameter;

$D_c$ = Cam tracks toothed sprocket diameter;

$D_s$ = Output shafts fixed toothed sprocket diameter;

$H$ = Number of the geometrical convex corners of the stationary housing;

$P$ = Number of the geometrical convex corners of the rotary piston;

$R_G$ = The ratio $D_h/D_p$ $R_T$ = The ratio $D_h/D_s$ $R_O$ = The ratio $D_h/D_c$;

$R_p = e$ = Radius from the output shaft axis to the center of gravity of the rotary piston for various positions of the rotary piston;

$e = R_p$ = Eccentricity of the rotary piston.

$D_e$ = Diameter of eccentricity.

From the foregoing it is clear that the gear system can be reduced to the following three relationships for the purpose of determining the values of Dh, Dp, Ds and DC:

I. $D_h = 2 \cdot H \cdot e$

II. $D_h = 2 \cdot p \cdot e$

Continued

III. $Ds = Dc = \frac{2 \cdot H \cdot e}{3}$

The above represents a system of three equations in seven unknowns and in which two of the unknowns are equal, thereby making the effective number of unknowns equal to six. It is thereby obvious that if any three of the unknowns are known or given, then the other three can be solved for by means of the foregoing simultaneous equations.

In discussing the practical limits of this invention it is useful to appreciate the value of the limitation factor L. L is defined as:

$$L = \sqrt{E}/K \geqq 1/1 < 1.5/1 \quad (169)$$

Where:

$L$ = *Limitation factor;*

$E$ = *Compression ratio (previously discussed);*

$K$ = *Ratio factor (previously discussed);*

In other words:

$$1 \leqq L \leqq 1.5 \quad (170)$$

It will be appreciated from the foregoing that the compression ratio $\sqrt{E}$ is proportional to L and that:

$$1 \leqq \sqrt{E}/K \leqq 1.5 \quad (171)$$

It follows then that the compression ratio is also proportional to the choice of R and e.

Of importance also are the following relationships:

$$C_h = K/H \geqq 1/1 < 2.75/1 \quad (172)$$

$$C_p = k_2/p \geqq 1/1 < 3/1 \quad (173)$$

or $$2.75 > C_h \geqq 1 \quad (174)$$

$$3 > C_p \geqq 1 \quad (175)$$

Where:

$C_h$ = Curve factor of the stationary housing curve profile $C_o$;

$C_p$ = Curve factor of the rotary piston curve profile $C_1$.

The foregoing relationships disclose the geometrical structure of the rotary piston engine with multiexplosion chambers according to the invention.

According to this invention, the rotary piston engine with multi explosion chambers can be developed with the required $H$ number of lobes or convex recesses. If the number $H$ is an even number, then the rotary piston engine will preferably have $H/2$ explosion chambers. In the event that the number $H$ is an odd number, then the rotary piston engine will preferably have $H$ explosion chambers. In all cases, the number $H$ may be limited because of the technical and economical considerations.

It is to be further understood that additional forms of this invention requiring the use of more dual explosion chambers and variations in the shape of the stationary housing and the rotary piston are within the scope of this invention.

In a general manner, while there has been disclosed effective and efficient embodiments of the invention it should be well understood that the invention is not limited to such embodiments as there might be changes made in the arrangement, disposition and form of the parts without departing from the principle of the present invention as comprehended within the scope of the accompanying claims.

I claim:

1. An improved multilobe rotary piston engine comprising:

a housing including $H$ lobes and having an interior cavity profile described by the curve generated by the locus of a point $P_h$ within the diameter $D_1$ of a rolling circle as it revolves around a second fixed circle of diameter $D_0$; and a piston having P lobes and a profile which permits operative engagement of the piston with the profile of the housing profile, said piston having a profile described by a curve generated by the locus of a point $P_p$ within the diameter $D_3$ of a rolling circle as it revolves around another fixed circle of a diameter $D_2$;

wherein the relationship between the profile of the housing and the profile of the piston is described as follows:

a. $H = P + 1$ b. $H = D_0/D_1$ c. $P = D_2/D_3$ d. $R = \frac{D_3 + D_2}{2}$ and e. $R + e = \frac{D_0 + D_1}{2}$ Where:

$H$ = The number of lobes on the stationary housing;

$P$ = The number of lobes on the piston;

$R$ = Minimum interior radius of the housing;

$e$ = The eccentricity of the rotary piston;

$D_0$ = Fixed circle diameter of the stationary housing;

$D_1$ = Rolling circle diameter of the stationary housing;

$D_2$ = Fixed circle diameter for the rotary piston; and $D_3$ =Rolling circle diameter for the rotary piston;

wherein said engine is further limited to operation in the following range of L:

$1 \leqslant L \leqslant 1.5$; and, $L = \sqrt{E}/K$

Where:

$L$ = Limitation range factor;

$E$ = the engine compression ratio; and, $K = R/e$ .

2. An improved multilobe rotary piston engine comprising:

a housing including $H$ lobes and having an interior cavity profile described by the curve generated by the locus of a point $P_h$ within the diameter $D_1$ of a rolling circle as it revolves around a second fixed circle of diameter $D_0$; and a piston having P lobes and a profile which permits operative engagement of the piston with the profile which permits operative engagement of the piston with the profile of the housing profile, said piston having a profile described by a curve generated by the locus of a point $P_p$ within the diameter $D_3$ of a rolling circle as it revolves around another fixed circle of diameter $D_2$;

wherein the relationship between the profile of the housing and the profile of the piston is described as follows:

a. $H = P + 1$ b. $H = D_0/D_1$ c. $P = D_2/D_3$ d. $R = \frac{D_3 + D_2}{2}$ and e. $R + e = \frac{D_0 + D_1}{2}$ Where:

$H$ = The number of lobes on the stationary housing;
$P$ = The number of lobes on the piston;
$R$ = Minimum interior radius of the housing;
$e$ = The eccentricity of the rotary piston;
$D_0$ = Fixed circle diameter of the stationary housing;
$D_1$ = Rolling circle diameter of the stationary housing;
$D_2$ = Fixed circle diameter for the rotary piston; and
$D_3$ = Rolling circle diameter for the rotary piston;

wherein said engine is further limited to operation in the following range of $C_h$ and $C_p$:

$2.75 > C_h \geqslant 1$; and, $3 > C_p \geqslant 1$

Where:

$C_h = \frac{K}{D_0/D_1}$ = Curve factor of the stationary housing curve profile;

$C_p = \frac{K_2}{D_2/D_3}$ = Curve factor of the rotary piston curve profile;

$K = R/e$; and, $K_2 = \frac{R - e}{e}$.

3. An improved multilobe rotary piston engine comprising:

a housing including H lobes and having an interior cavity profile described by the curve generated by the locus of a point $P_h$ within the diameter $D_1$ of a rolling circle as it revolves around a second fixed circle of diameter $D_0$; and a piston having P lobes and a profile which permits operative engagement of the piston with the profile of the housing profile, said piston having a profile described by a curve generated by the locus of a point Pwithin the diameter $D_3$ of a rolling circle as it revolves around another fixes circle of diameter $D_2$;

wherein the relationship between the profile of the housing and the profile of the piston is described as follows:

a. $H = P + 1$ b. $H = D_0/D_1$ c. $P = D_2/D_3$ d. $R = \frac{D_3 + D_2}{2}$ and e. $R + e = \frac{D_0 + D_1}{2}$ Where:

$H$ = The number of lobes on the stationary housing;
$P$ = The number of lobes on the piston;
$R$ = Minimum interior radius of the housing;
$e$ = The eccentricity of the rotary piston;
$D_0$ = Fixed circle diameter of the stationary housing;
$D_1$ = Rolling circle diameter of the stationary housing;
$D_2$ = Fixed circle diameter for the rotary piston; and
$D_3$ = Rolling circle diameter for the rotary piston;

said engine further including a planetary gearing system comprising:

an internal gear $G_h$ of diameter $D_h$ affixed firmly to the stationary housing;

an internal gear $G_p$ of diameter $D_p$ affixes firmly to the piston;

a planetary gear $D_c$ of diameter $D_c$ operatively engaging both the internal gears $G_h$ and $G_p$; and an output shaft drive $D_s$ of diameter $D_s$ operatively engaged with said planatary gear;

wherein the diameters of $D_h$, $D_p$, $D_c$ and $D_s$ are related as follows:

a. $D_h = 2 \cdot H \cdot e$ b. $D_p = 2 \cdot P \cdot e$ and c. $D_s = D_c = \frac{2 \cdot H \cdot e}{3}$ Where:

$D_h$ = Stationary housing internal gear diameter;
$D_p$ = Rotary piston internal gear diameter;
$D_c$ = Planetary gear cam toothed sprocket diameter; and
$D_s$ = Output shaft fixed tooth sprocket diameter.

4. The invention of claim 3 wherein the curve profile of the housing is an epitrochoid.

5. The invention of claim 4 wherein the curve profile of the piston is an epitrochoid.

6. The invention of claim 4 wherein H $\leqslant$ 7.

* * * * *